US008543022B2

(12) United States Patent
Obara et al.

(10) Patent No.: US 8,543,022 B2
(45) Date of Patent: Sep. 24, 2013

(54) IMAGE FORMING APPARATUS

(75) Inventors: Mitsuru Obara, Toyohashi (JP); Shigeki Naiki, Toyokawa (JP); Masahiro Kouzaki, Toyohashi (JP); Yusuke Mamiya, Nagoya (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 229 days.

(21) Appl. No.: 13/026,737

(22) Filed: Feb. 14, 2011

(65) Prior Publication Data

US 2011/0211852 A1 Sep. 1, 2011

(30) Foreign Application Priority Data

Feb. 26, 2010 (JP) ..... 2010-042226

(51) Int. Cl.
*G03G 15/00* (2006.01)
*G03G 15/08* (2006.01)

(52) U.S. Cl.
USPC ..... 399/49; 399/254

(58) Field of Classification Search
USPC ..... 399/49, 53, 254, 255
See application file for complete search history.

(56) References Cited

U.S. PATENT DOCUMENTS 6,055,388 A 4/2000 Watanabe et al.

FOREIGN PATENT DOCUMENTS

JP 06230675 A * 8/1994
JP 08-062984 A 3/1996
JP 09006120 A * 1/1997
JP 10-333421 A 12/1998
JP 2006-194955 A 7/2006
JP 2007-121939 A 5/2007
JP 2010-008931 A 1/2010
JP 2010008931 A * 1/2010

OTHER PUBLICATIONS

Takeuchi (JP 2010-008931 A) Jan. 2010, JPO Machine Translation.*
Office Action (Notification of Reasons for Refusal) dated Jan. 24, 2012, issued in the corresponding Japanese Patent Application No. 2010-042226, and an English Translation thereof. (6 pages).

* cited by examiner

*Primary Examiner* — David Gray
*Assistant Examiner* — Erika J Villaluna
(74) *Attorney, Agent, or Firm* — Buchanan Ingersoll & Rooney PC

(57) ABSTRACT

An image forming apparatus having an image carrier; an electrostatic latent image forming device that forms an electrostatic latent image on the image carrier; a development device having a housing section that stores toner therein, a stirring device for stirring the toner inside the housing section, and a toner, carrier that develops the electrostatic latent image into a toner image by imparting the toner to the image carrier; a voltage applying device that applies a development bias voltage between the image carrier and the toner carrier; a control device that makes the electrostatic latent image forming device and the development device form a test toner image on the image carrier; and a sensing device that senses a toner adhering amount of the test toner image. The control device determines whether to make the stirring device stir the toner based upon a relation between the toner adhering amount of the test toner image and the development bias voltage that was applied by the voltage applying device for formation of the test toner image.

10 Claims, 5 Drawing Sheets

IMAGE FORMING APPARATUS

This application is based on Japanese Patent Application No. 2010-042226 filed on Feb. 26, 2010, the content of which is incorporated herein by reference.

BACKGROUND OF THE INVENTION

1. Field of the Invention

The present invention relates to an image forming apparatus, and particularly relates to an image forming apparatus that forms an image by means of toner.

2. Description of Related Art

In an image forming apparatus, toner stored in a development unit decreases in volume under its own weight when it is left unstirred for a long period of time. When the volume of the toner decreases as thus described, a charge amount of the toner might become insufficient. It consequently becomes difficult to obtain a sufficient toner adhering amount upon forming a toner image.

As an image forming apparatus for solving the above problem, there is known, for example, an image forming apparatus described in Japanese Patent Laid-Open Publication No. H08-62984. In the image forming apparatus described in Japanese Patent Laid-Open Publication No. H08-62984, a stirring roller is rotated at a higher rate than usual when the development unit has been stopped for a predetermined time or longer. This can lead to recovery of the volume of the toner, and to recovery of the charge amount of the toner.

However, the image forming apparatus described in Japanese Patent Laid-Open Publication No. H08-62984 may stir the toner unnecessarily. More specifically, the charge amount of the toner does not depend only upon the volume of the toner. Therefore, even when the toner has been left unstirred for a long period of time and the volume of the toner has decreased, a sufficient charge amount may be obtainable. In such a case, rotating the stirring roller is not necessary. However, in the image forming apparatus described in Japanese Patent Laid-Open Publication No. H08-62984, the stirring roller is rotated on only a condition that the development unit has been stopped for a predetermined time or longer. Consequently, the image forming apparatus described in Japanese Patent Laid-Open Publication No. H08-62984 may execute unnecessary stirring.

SUMMARY OF THE INVENTION

An image forming apparatus according to an embodiment of the present invention comprises: an image carrier; an electrostatic latent image forming device that forms an electrostatic latent image on the image carrier; a development device having a housing section that stores toner therein, a stirring device for stirring the toner inside the housing section, and a toner carrier that develops the electrostatic latent image into a toner image by imparting the toner to the image carrier; a voltage applying device that applies a development bias voltage between the image carrier and the toner carrier; a control device that makes the electrostatic latent image forming device and the development device form a test toner image on the image carrier; and a sensing device that senses a toner adhering amount of the test toner image; wherein the control device determines whether to make the stirring device stir the toner based upon a relation between the toner adhering amount of the test toner image and the development bias voltage that was applied by the voltage applying device for formation of the test toner image.

BRIEF DESCRIPTION OF DRAWINGS

This and other features of the present invention will be apparent from the following description with reference to the accompanying drawings, in which.

DETAILED DESCRIPTION OF THE PREFERRED EMBODIMENTS

Structure of Image Forming Apparatus

Figure 1:
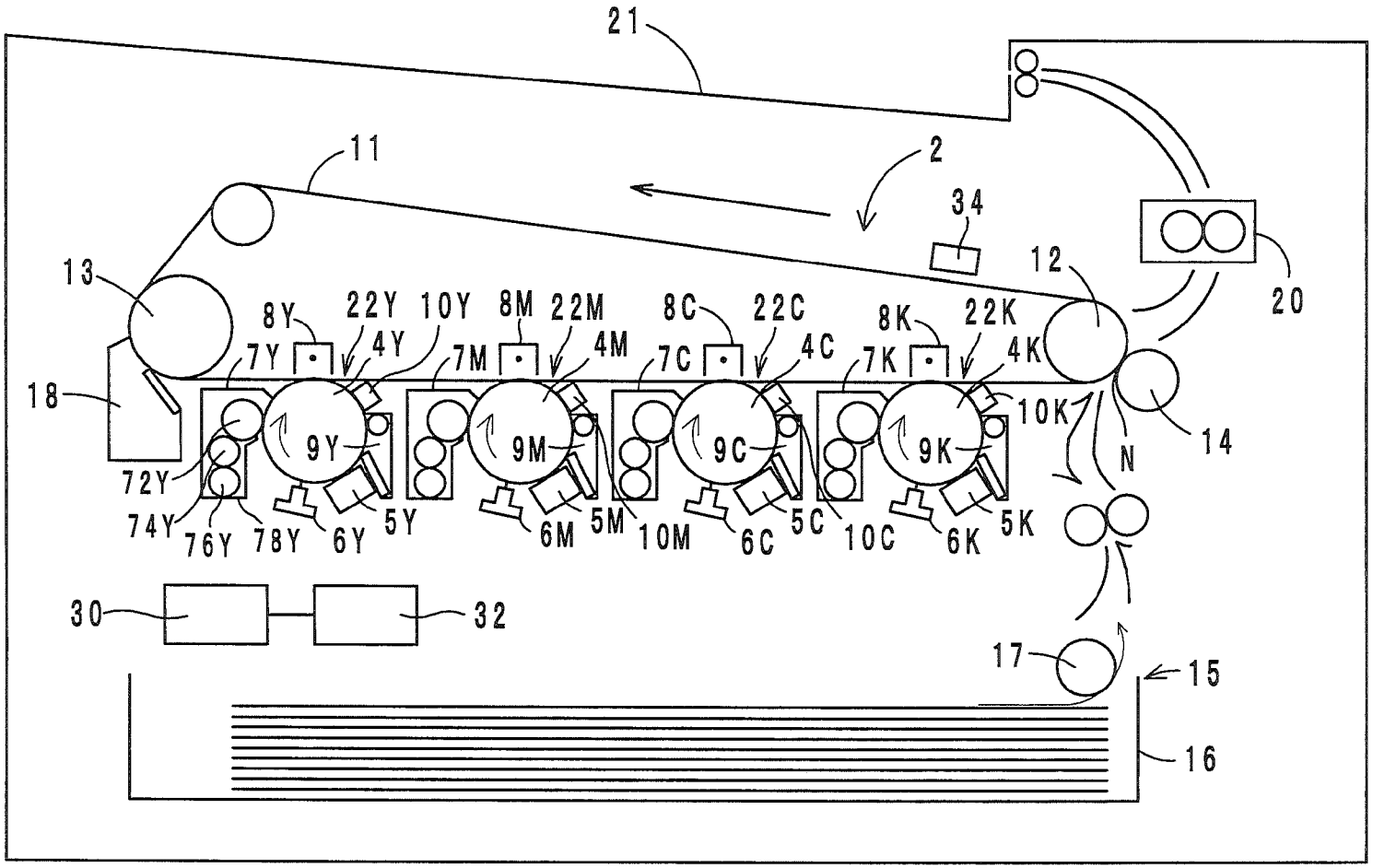
FIG. 1 is a view showing an overall configuration of an image forming apparatus according to an embodiment of the present invention.

Hereinafter, an image forming apparatus according to an embodiment of the present invention is described with reference to the drawings. FIG. 1 is a view showing an overall structure of an image forming apparatus 1 according to the embodiment of the present invention.

An image forming apparatus 1 is an electrophotographic color printer of a tandem type, which is configured so as to synthesize an image of four colors, namely, Y (yellow), M (magenta), C (cyan) and K (black). The image forming apparatus 1 has a function of forming an image on paper (print medium) based upon image data read by a scanner, and includes a printing section 2, a paper feeding section 15, a fixing unit 20, a paper discharge tray 21, a control section 30, a voltage applying section 32, and a sensor 34.

The paper feeding section 15 serves to feed paper piece by piece, and includes a paper tray 16 and a paper feeding roller 17. In the paper tray 16, a plurality of pieces of paper in a pre-printed state is stacked and placed. The paper feeding roller 17 takes out the paper from the paper tray 16 piece by piece.

The printing section 2 forms a toner image on paper being fed from the paper feeding section 15. The printing section 2 includes: image forming sections 22Y, 22M, 22C, 22K; transfer sections 8Y, 8M, 8C, 8K; an intermediate transfer belt 11; a driving roller 12, a driven roller 13, a secondary transfer roller 14, and a cleaning unit 18. Further, the image forming sections 22Y, 22M, 22C, 22K include: photosensitive drums (image carriers) 4Y, 4M, 4C, 4K; chargers 5Y, 5M, 5C, 5K; exposure units 6Y, 6M, 6C, 6K; development units 7Y, 7M, 7C, 7K; cleaners 9Y, 9M, 9C, 9K, and erasers 10Y, 10M, 10C, 10K. It is to be noted that, hereinafter, in the case of collectively naming the photosensitive drums, the chargers, the exposure units, the development units, the transfer units, the cleaners, the erasers and the image forming sections, those are simply described respectively as a photosensitive drum 4, a charger 5, an exposure unit 6, a development unit 7, a transfer unit 8, a cleaner 9, an eraser 10 and an image forming section 22. In the case of indicating the individual photosensitive drums, chargers, exposure units, development units, transfer units, cleaners, erasers and image forming sections, those are respectively described as the photosensitive drums 4Y, 4M, 4C, 4K, the chargers 5Y, 5M, 5C, 5K, the exposure units 6Y, 6M, 6C, 6K, the development units 7Y, 7M, 7C, 7K, the transfer units 8Y, 8M, 8C, 8K, the cleaners 9Y, 9M, 9C, 9K, the erasers 10Y, 10M, 10C, 10K and the image forming sections 22Y, 22M, 22C, 22K.

The charger 5 charges the peripheral surface of the photosensitive drum 4. The exposure unit 6 applies laser by control of the control section 30. Thereby, an electrostatic latent image is formed on the peripheral surface of the photosensitive drum 4. That is, the charger 5 and the exposure unit 6 serve as an electrostatic latent image forming device that forms an electrostatic latent image on the peripheral surface of the photosensitive drum 4.

As shown in FIG. 1, the development unit 7 includes a development roller 72, a feeding roller 74, a stirring roller 76, and a housing section 78. In FIG. 1, for the sake of simplicity of the drawing, only a development roller 72Y, a feeding roller 74Y, a stirring roller 76Y, and a housing section 78Y of the development unit 7Y are provided with reference numerals. The housing section 78 constitutes a body of the development unit 7, and houses the development roller 72, the feeding roller 74 and the stirring roller 76. Also, toner is stored in the housing section 78. The stirring roller 76 stirs the toner inside the housing section 78 to negatively charge the toner. The feeding roller 74 feeds the negatively charged toner to the development roller 72. The development roller 72 imparts the toner to the photosensitive drum 4. Specifically, the voltage applying section 32 applies a negative development bias voltage to the development roller 72 so as to form a development field between the photosensitive drum 4 and the development roller 72. Since the toner is negatively charged, the toner moves from the development roller 72 to the photosensitive drum 4 under the influence of the development field. Further, since the electrostatic latent image is formed on the photosensitive drum 4, the toner adheres to the photosensitive drum 4 based upon the electrostatic latent image. A toner image based upon the electrostatic latent image is thereby developed on the photosensitive drum 4.

The intermediate transfer belt 11 is extended between the driving roller 12 and the driven roller 13, and the toner image formed on the photosensitive drum 4 is primarily transferred. The transfer section 8 is arranged so as to face to the inner peripheral surface of the intermediate transfer belt 11. The transfer section 8 is impressed with a primary transfer voltage and serves to transfer the toner image formed on the photosensitive drum 4 to the intermediate transfer belt 11 (primary transfer). The cleaner 9 serves to collect toner that remains on the peripheral surface of the photosensitive drum 4 after the primary transfer. The driving roller 12 is rotated by an intermediate transfer belt driving section (not shown in FIG. 1) to drive the intermediate transfer belt 11. In this manner, the intermediate transfer belt 11 carries the toner image to the secondary transfer roller 14. The sensor 34 is provided so as to face to the intermediate transfer belt 11, and senses a toner adhering amount of a test toner image, which will be describer later.

The secondary transfer roller 14 is opposed to the intermediate transfer belt 11 so as to form a nip section N. The secondary transfer roller 14 transfers the toner image that has been carried by the intermediate transfer belt 11 to paper that has been delivered from the paper feeding section 15 and is passing through the nip section N (secondary transfer). The cleaning unit 18 removes toner that remains on the intermediate transfer belt 11 after the secondary transfer of the toner image to the paper.

The paper with the toner image transferred thereto is delivered to the fixing unit 20. The fixing unit 20 performs a heat treatment and a pressure treatment on the paper to fix the toner image to the paper. In the paper discharge tray 21, printed paper is placed.

Figure 2:
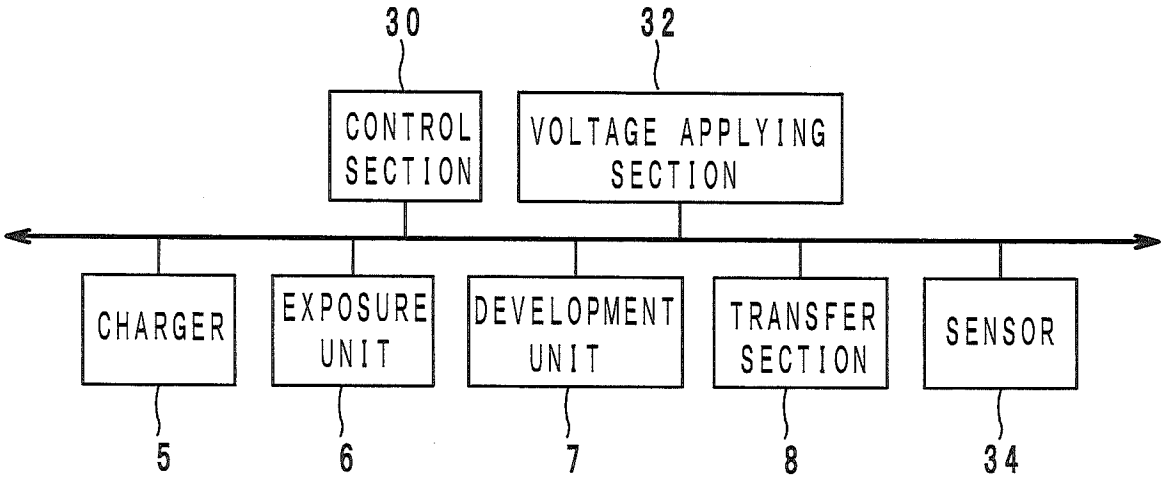
FIG. 2 is a block diagram of the image forming apparatus.

Next, a control configuration of the image forming apparatus 1 is described with reference to the drawings. FIG. 2 is a block diagram of the image forming apparatus 1. FIG. 2 illustrates the charger 5, the exposure unit 6, the development unit 7, the transfer unit 8, the control section 30, the voltage applying section 32, and the sensor 34. As shown in FIG. 2, the charger 5, the exposure unit 6, the development unit 7, the transfer unit 8, the voltage applying section 32 and the sensor 34 are connected to the control section 30 through a bus. Further, the control section 30 controls operations of the charger 5, the exposure unit 6, the development unit 7, the transfer unit 8, the voltage applying section 32 and the sensor 34, and is configured by a CPU, for example.

Test

Figure 3:
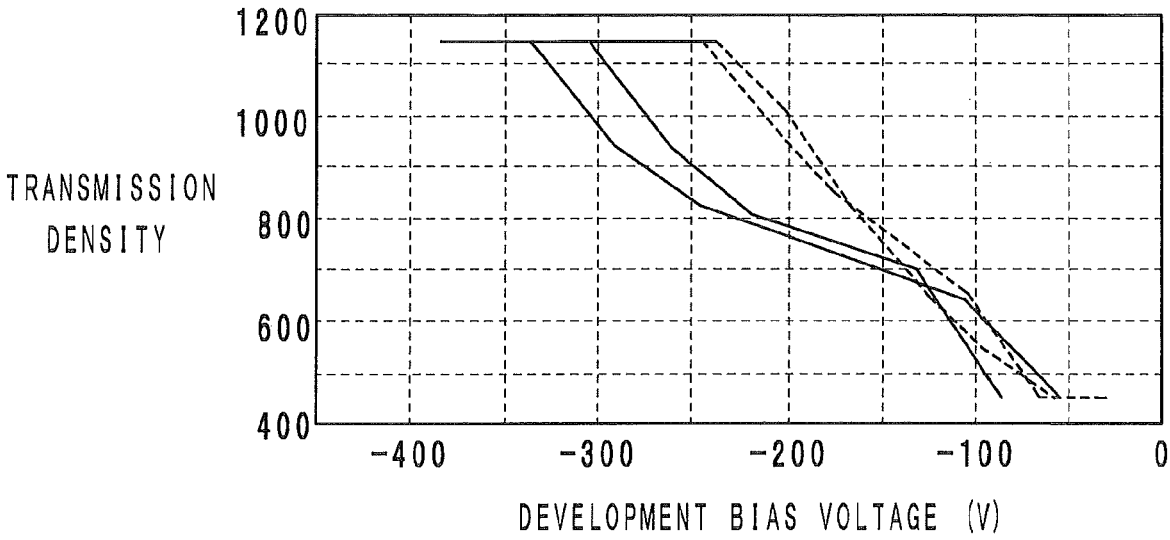
FIG. 3 is a graph showing test results, as well as a graph showing a development characteristic.

Next, tests performed by the present inventors are described. The present inventors performed the following tests in order to ensure that a sufficient toner adhering amount on paper is not obtained when toner is left unstirred for a long period of time. Specifically, using toner left unstirred and toner not left unstirred for a long period of time, the present inventors made the image forming apparatus 1 print toner images of a solid pattern on paper, while changing the development bias voltage. Next, the present inventors checked a transmission density of the paper with the toner image printed thereon. The transmission density indicates a degree of interception of light incident to the paper by the toner image. When the transmission density is high, it indicates that a transmitted amount of light is small, and a large amount of toner has adhered. When the transmission density is low, it indicates that a transmitted amount of light is large, and a small amount of toner has adhered. That is, the transmission density is synonymous with the toner adhering amount. FIG. 3 is a graph showing test results, and the curves in the graph show development characteristics. In the graph, the horizontal axis indicates the development bias voltage, and the vertical axis indicates the transmission density. Further, the solid lines indicate results of the tests performed by using the toner left unstirred, and the dotted lines indicate results of the tests performed by using the toner not left unstirred.

According to FIG. 3, it is found that in the case of using the toner left unstirred, as compared with the case of using the toner not left unstirred, an equivalent transmission density cannot be obtained unless a development bias voltage with a large absolute value is applied. In other words, this means that the charge amount of the toner is insufficient in the case of the toner left unstirred, and the toner does not sufficiently adhere to paper unless a larger development bias voltage than usual is applied.

Figure 4:
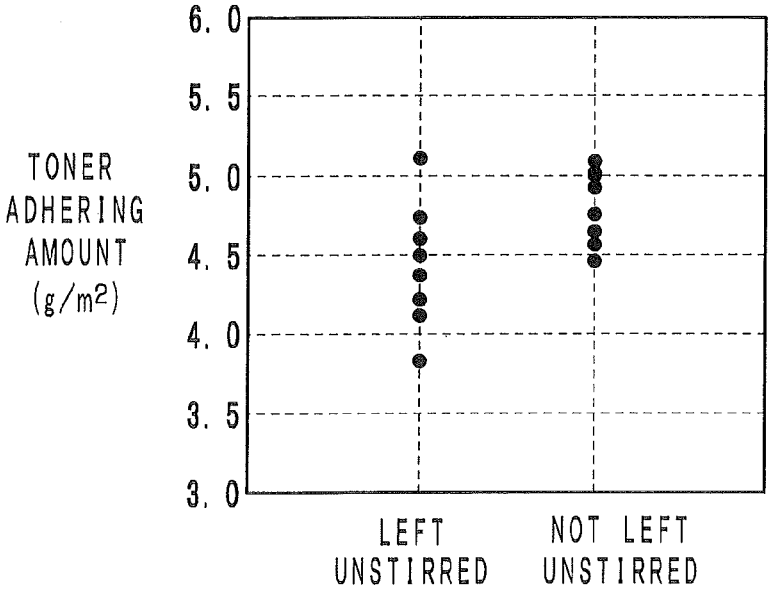
FIG. 4 is a graph showing test results, as well as a graph showing toner adhering amounts in the case of using toner left unstirred and in the case of using toner not left unstirred.

Next, the present inventors performed the following tests for ensuring whether or not the toner always insufficiently adheres to paper in the case of using the toner left unstirred. Specifically, using the toner left unstirred and the toner not left unstirred, the present inventors made the image forming apparatus 1 perform stabilizing operation, to form a toner image of a test pattern as the solid pattern on the intermediate transfer belt 11. Then, the sensor 34 was used to sense a toner adhering amount of the test pattern formed on the intermediate transfer belt 11. FIG. 4 is a graph showing test results, that is, a graph showing toner adhering amounts in the case of using the toner left unstirred and in the case of using the toner not left unstirred.

According to FIG. 4, it is found that in the case of using the toner not left unstirred, the toner adhering amount distributes between 4.5 to 5.1 g/m$^2$. On the other hand, it is found that in the case of using the toner left unstirred, the toner adhering amount distributes between 3.8 to 5.1 g/m$^2$. That is, it is found that the toner adhering amount has a wide distribution in the case of using the toner left unstirred as compared with the case of using the toner not left unstirred. This means that, even when the toner is left unstirred for a long period of time, the charge amount of the toner does not always decreases. It is thus found that, even after the toner has been left unstirred for a long period of time, it is not always necessary to stir the toner with the stirring roller 76. Thereat, the present inventors invented the image forming apparatus 1 that performs operations described below.

Operation of Image Forming Apparatus

Figure 5:
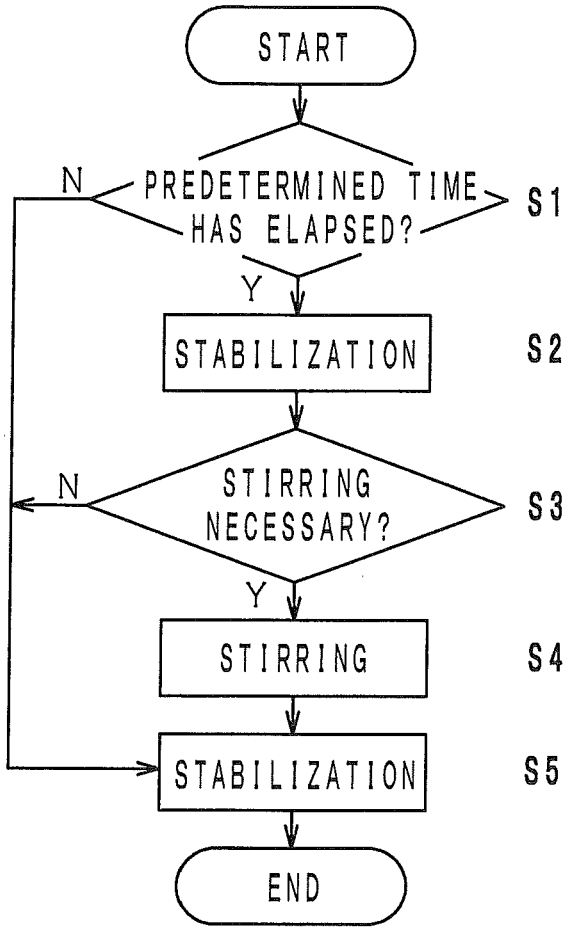
FIG. 5 is a flowchart of operations performed by a control section of the image forming apparatus.

Hereinafter, the operation of the image forming apparatus 1 is described with reference to the drawings. FIG. 5 is a flowchart of operations performed by the control section 30 of the image forming apparatus 1.

The control section 30 checks whether or not a predetermined time has elapsed since the control section 30 made the stirring roller 76 stir the toner most recently (Step S1). The predetermined time is the minimum time during which the toner is left unstirred to cause a decrease in volume of the toner and insufficient charge amount of the toner. An example of the predetermined time is the order of twelve hours. When the predetermined time has elapsed, the process goes to Step S2. When the predetermined time has not elapsed, the process is completed.

When the predetermined time has elapsed, the control section 30 makes the printing section 2 execute the stabilizing operation (Step S2). Specifically, the control section 30 makes the charger 5, the exposure unit 6 and the development unit 7 form the toner image of the test pattern on the peripheral surface of the photosensitive drum 4. Further, the control section 30 makes the transfer section 8 transfer the test pattern from the photosensitive drum 4 to the intermediate transfer belt 11. The control section 30 then makes the intermediate transfer belt driving section drive the intermediate transfer belt 11. Moreover, the control section 30 obtains a toner adhering amount of the test pattern which is outputted from the sensor 34. It should be noted that in the stabilizing operation, the control section 30 makes the voltage applying section 32 apply a plurality of different development bias voltages to obtain a plurality of different toner adhering amounts. That is, in the stabilizing operation, the control section 30 obtains a development characteristic curve (as shown in FIG. 3) showing the relation between the toner density of the test image and the development bias voltage applied by the voltage applying section 32 for formation of the test toner image.

Next, referring to the development characteristic curves shown in FIG. 3, which were obtained in Step S2, the control section 30 checks whether or not to execute stirring of the toner (Step S3). Specifically, with respect to the development characteristic curve obtained at Step S3, the control section 30 checks whether or not an average inclination of the characteristic curve, wherein absolute values of the, development bias voltage and toner adhering amounts are spotted in the x axis and in the y axis, respectively, is larger than a predetermined value. When the average inclination is larger than the predetermined value, the control section 30 determines that the toner can be sufficiently charged and determines to keep the stirring roller 76 from stirring the toner. On the other hand, when the average inclination is not larger than the predetermined value, the control section 30 determines that the toner cannot be sufficiently charged and determines to make the stirring roller 76 stir the toner.

It is to be noted that for example, a least-square method can be adopted to calculate the average inclination. Further, as shown in FIG. 3, the transmission density is saturated when the absolute value of the development bias voltage is very large. Hence in the case of calculating the average inclination, it is desirable to use values within a range where the transmission density is not saturated (e.g., −100 to −200 V). Moreover, the predetermined value here is the maximum inclination that can be regarded to prevent achievements of sufficient charge amount of the toner and a sufficient toner adhering amount. For example, in FIG. 3, the predetermined value is a value between average inclinations of the test results indicated by the dotted lines and average inclinations of the test results indicated by the solid lines.

In the case of executing stirring, the process goes to Step S4. In the case of not executing stirring, the process is completed.

In the case of executing stirring, the control section 30 makes the stirring roller 76 execute stirring (Step S4). Further, as in Step S2, the control section 30 executes the stabilizing operation (Step S5). Then, the process is completed.

Effect

The image forming apparatus 1 performs the stabilizing operation when toner has been left unstirred for a long period of time. Further, the image forming apparatus 1 checks whether or not a sufficient charge amount of the toner can be obtained, and stirs the toner only when the sufficient charge amount of the toner cannot be obtained. That is, even when the toner has been left unstirred for a long period of time, the image forming apparatus 1 does not stir the toner if a sufficient charge amount of the toner can be obtained. Therefore, in the image forming apparatus 1, unnecessary stirring of toner will not be executed.

Other Embodiments

The image forming apparatus 1 is not restricted to the apparatus shown in the foregoing embodiment, but can be modified within the range of its gist. The determination made by the control section 30 at Step S3 may be, for example, based upon a condition other than the average inclination of a development characteristic. Specifically, the determination may be made based upon whether or not the toner adhering amount obtained with a predetermined development bias voltage applied by the voltage applying section 32 is larger than a predetermined value. In this case, when the toner adhering amount is larger than the predetermined toner adhering amount, the control section 30 determines that stirring is unnecessary. When the toner adhering amount is not larger than the predetermined toner adhering amount, the control section 30 determines that stirring is necessary. It should be noted that the predetermined development bias voltage is a value set within the range (e.g., −100 to −200 V) of the development bias voltage where the transmission density is not saturated in FIG. 3. Further, the predetermined toner adhering amount is the maximum toner adhering amount with which it can be regarded that the charge amount of the toner is insufficient and a sufficient toner adhering amount cannot be obtained.

Incidentally, in the image forming apparatus 1, when the toner is left unstirred for a long period of time, the volume of the toner decreases, and accordingly, in this state, the amount of toner stored inside the development unit 7 is larger than it appears. When toner is replenished to the development unit 7 in this state, the toner inside the development unit 7 becomes larger than the capacity.

Figure 6:
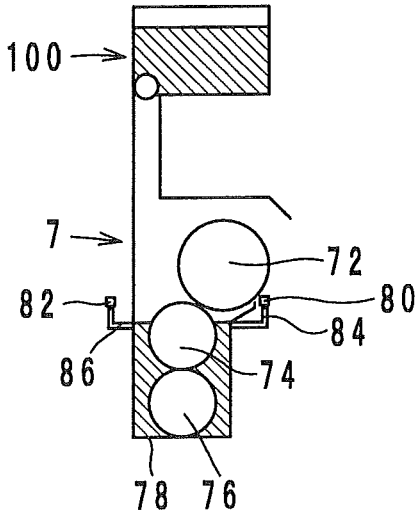
FIG. 6 is a view showing a development unit provided with a replenishment unit.

Therefore, in the image forming apparatus 1, a toner replenishing operation is performed under a control method peculiar to this image forming apparatus 1. Hereinafter, the replenishment of the toner of the image forming apparatus 1 is described with reference to the drawings. FIG. 6 is a view showing the development unit 7 provided with a replenishment unit 100.

As shown in FIG. 6, the replenishment unit 100 is disposed above the development unit 7. Further, the development unit 7 is provided with a light-emitting element 80, a light-receiving element 82, and light guides 84, 86. The light-emitting element 80 emits light. The light guides 84, 86 are disposed on a predetermined level in the housing section 78. The light guide 84 guides light emitted by the light-emitting element 80 to the housing section 78. The light guided to the housing section 78 passes through the inside of the housing section 78 and is incident to the light guide 86. The light guide 86 guides the light that has passed through the inside of the housing section 78 to the light-receiving element 82. The light-receiving element 82 senses whether or not to have received light, and outputs a sensing result toward the control section 30. Based upon the sensing result of the light-receiving element 82, the control section 30 determines whether or not a sufficient volume of toner is stored in the housing section 78. Specifically, when obtaining a sensing result from the light-receiving element 82 which indicates reception of light, the control section 30 determines that the volume of the toner inside the housing section 78 has decreased to be smaller than a predetermined value. On the other hand, when obtaining a sensing result from the light-receiving element 82 which indicates non-reception of light, the control section 30 determines that the volume of the toner inside the housing section 78 has not decreased to be smaller than the predetermined value.

Herein, when the control section 30 determines that the volume of the toner inside the housing section 78 has decreased to be smaller than the predetermined value, the control section 30 next checks whether or not a predetermined time (e.g., twelve hours) or longer has elapsed since the control section 30 made the stirring roller 76 stir the toner most recently. Then, when the control section 30 determines that the predetermined time or longer has elapsed, the control section 30 makes the stirring roller 76 stir the toner while keeping the replenishment unit 100 from replenishing toner. Then, after the stirring of the toner, the control section 30 again checks whether the volume of the toner inside the housing section 78 has decreased to be smaller than the predetermined value. Then, when the control section 30 determines that the volume of the toner has not decreased to be smaller than the predetermined value, the control section 30 keeps the replenishment unit 100 from replenishing toner. This prevents the toner inside the development unit 7 from becoming larger than the capacity.

The present invention is useful for an image forming apparatus and is capable of obtaining a sufficient charge amount of toner without executing unnecessary stirring.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An image forming apparatus comprising:

an image carrier;

an electrostatic latent image forming device that forms an electrostatic latent image on the image carrier;

a development device having a housing section that stores toner therein, a stirring device for stirring the toner inside the housing section, and a toner carrier that develops the electrostatic latent image into a toner image by imparting the toner to the image carrier;

a voltage applying device that applies a development bias voltage between the image carrier and the toner carrier;

a control device that makes the electrostatic latent image forming device and the development device form a test toner image on the image carrier; and a sensing device that senses a toner adhering amount of the test toner image, wherein the control device determines whether to make the stirring device stir the toner based upon a relation between the toner adhering amount of the test toner image and the development bias voltage that was applied by the voltage applying device for formation of the test toner image.

2. The image forming apparatus according to claim 1, wherein the control device makes the electronic latent image forming device and the development device form a plurality of test toner images with different development bias voltages applied by the voltage applying device, obtains from the sensing device the toner adhering amounts of the respective test toner images, and keeps the stirring device from stirring the toner when an average inclination of a characteristic curve, wherein absolute values of the development bias voltages and the toner adhering amounts are plotted in an x axis and in a y axis, respectively, showing a relation between the development bias voltage and the toner adhering amount, is larger than a predetermined value.

3. The image forming apparatus according to claim 1, wherein the control device keeps the stirring device from stirring the toner when the toner adhering amount of the test toner image formed with a predetermined development bias voltage applied by the voltage applying device is larger than a predetermined value.

4. The image forming apparatus according to claim 1, wherein when a predetermined time or longer has elapsed since the control device made the stirring device stir the toner most recently, the control device makes the electrostatic latent image forming device and the development device form a test toner image on the image carrier.

5. The image forming apparatus according to claim 1, wherein the development device further has a replenishment device that replenishes the housing section with toner, and wherein when the predetermined time or longer has elapsed since the control device made the stirring device stir the toner most recently, the control device keeps the replenishment device from replenishing the housing section with toner until making the stirring device complete stirring the toner next time.

6. A method for stirring toner in a developing device that is employed in an image forming apparatus to develop an electrostatic latent image formed on an image carrier into a toner image, said method comprising:

a first step of forming an electrostatic latent image of a test pattern on the image carrier;

a second step of developing the electrostatic latent image of the test pattern into a test toner image by imparting toner to the electrostatic latent image by applying a development bias voltage between a toner carrier for carrying toner and the image carrier;

a third step of detecting a toner adhering amount on the developed test toner image; and a fourth step of determining whether to perform stirring of toner based on a relation between the toner adhering amount on the developed test toner image and the development bias voltage applied for the development of the electrostatic latent image of the test pattern into the test toner image.

7. The method for stirring toner according to claim 6, wherein toner adhering amounts of a plurality of test toner images formed by applying different development bias voltages are obtained by executing the first step, the second step and the third step a plurality of times; and wherein in the fourth step, it is determined not to perform stirring of toner when an average inclination of a characteristic curve, wherein absolute values of the development bias voltages and the toner adhering amounts are plotted in an x axis and in a y axis, respectively, showing a relation between the development bias voltage and the toner adhering amount, is larger than a predetermined value.

8. The method for stirring toner according to claim 6, wherein in the fourth step, it is determined not to perform stirring of toner when the toner adhering amount of the test toner image formed by applying a predetermined development bias voltage is larger than a predetermined value.

9. The method for stirring toner according to claim 6, wherein when a predetermined time or longer has elapsed since stirring of toner performed most recently, the first step, the second step, the third step and the fourth step are executed.

10. The method for stirring toner according to claim 6, wherein the image forming apparatus further comprises a replenishment device for replenishing the developing device with toner, and wherein when a predetermined time or longer has elapsed since stirring of toner performed most recently, the replenishment device is kept from replenishing the developing device with toner until stirring of toner performed next is finished.

* * * * *